US007258594B2

(12) United States Patent
Junker

(10) Patent No.: US 7,258,594 B2
(45) Date of Patent: Aug. 21, 2007

(54) METHOD AND DEVICE FOR CENTERLESS CYLINDRICAL GRINDING

(75) Inventor: Erwin Junker, Buehl/Baden (DE)

(73) Assignee: BSH Holice A.S., Holice (CZ)

( * ) Notice: Subject to any disclaimer, the term of this patent is extended or adjusted under 35 U.S.C. 154(b) by 27 days.

(21) Appl. No.: 10/487,511

(22) PCT Filed: Aug. 6, 2002

(86) PCT No.: PCT/EP02/08779

§ 371 (c)(1),
(2), (4) Date: Feb. 17, 2004

(87) PCT Pub. No.: WO03/015983

PCT Pub. Date: Feb. 27, 2003

(65) Prior Publication Data

US 2004/0209558 A1 Oct. 21, 2004

(30) Foreign Application Priority Data

Aug. 14, 2001 (DE) ..... 101 39 894

(51) Int. Cl.
*B49D 1/00* (2006.01)

(52) U.S. Cl. ..... 451/5; 451/8; 451/9; 451/10; 451/11; 451/49; 451/177; 451/241; 451/242; 451/364; 451/397; 451/407

(58) Field of Classification Search ..... 451/5, 451/8, 9, 10, 11, 49, 177, 241, 242, 364, 397, 451/407

See application file for complete search history.

(56) References Cited

U.S. PATENT DOCUMENTS

| | | | | |
|---|---|---|---|---|
| 3,503,159 A | | 3/1970 | Schaller | |
| 4,055,027 A | | 10/1977 | Freddi | |
| 4,580,370 A | * | 4/1986 | Smith | 451/49 |
| 4,926,603 A | * | 5/1990 | Frost et al. | 451/5 |
| 5,567,195 A | * | 10/1996 | Tufts et al. | 451/11 |
| 5,643,051 A | | 7/1997 | Zhou et al. | |
| 5,746,644 A | * | 5/1998 | Cheetham | 451/6 |
| 6,368,185 B1 | * | 4/2002 | Glenville | 451/9 |

FOREIGN PATENT DOCUMENTS

DE 32 02 341 8/1983

(Continued)

*Primary Examiner*—Joseph J. Hail, III
*Assistant Examiner*—Shantese McDonald
(74) *Attorney, Agent, or Firm*—Jordan and Hamburg LLP

(57) ABSTRACT

During centerless cylindrical grinding, attention must be paid to the fact that the workpiece (3) is placed in a very specific position between the grinding wheel (1), the regulating wheel (2) and the support guide (4). The optimal position of the workpiece (3) initially set cannot be maintained as a result of the progression of the grinding process and the changes caused by said process in the diameter and contour of the workpiece (3). The invention provides a solution to said problem, whereby height adjustment and/or the oblique position of the support guide (4) are automatically modified in accordance with the progression of the grinding process and during said grinding process with the purpose of achieving operationally optimal readjustment. The progression of the grinding process can be detected using measuring techniques, e.g. by measuring the diameter of the workpiece (3) or its deviation from roundness and using said measurement as output variable for adjusting the support guide (4).

18 Claims, 3 Drawing Sheets

FOREIGN PATENT DOCUMENTS

| | | |
|---|---|---|
| DE | 233 336 A | 2/1986 |
| DE | 197 15 606 | 10/1998 |
| EP | 0 272 661 | 6/1988 |
| EP | 0 297 926 | 1/1989 |
| EP | 0 498 763 | 8/1992 |
| GB | 308874 | 4/1929 |
| GB | 2 185 515 | 6/1987 |

* cited by examiner

METHOD AND DEVICE FOR CENTERLESS CYLINDRICAL GRINDING

BACKGROUND

The invention relates to a method for centerless cylindrical grinding, for which the rotationally symmetrical workpiece is located between the grinding disk, the regulating wheel and the support guide during the grinding process and for which the distance between the grinding disk and the regulating wheel as well as the height setting of the support guide can be adjusted selectively during the grinding process.

A method of this type, which is frequently also referred to in practice as "centerless method", is known, for example, from the DE 32 02 341 A1. In this publication, it is stated that the position of the workpiece between the grinding disk, the regulating wheel and the support guide, optimum for the grinding process and required for an optimum grinding result, cannot be adjusted easily. Since the regulating wheel must also bring about the advance of the workpiece, it assumes a position that is tilted slightly out of the horizontal. The workpiece lies in a manner, which cannot be defined precisely, between the regulating wheel and the support guide; in this position, it is pressed in by the grinding disk. It is advantageous here for the support guide to be also tilted slightly out of the horizontal. The determining process parameters for preparing the machine for the grinding process are the axial distance between the grinding disk and the regulating wheel, as well as the height adjustment of the support guide. For each diameter of a workpiece, there is a most suitable axial distance from the grinding disk and the regulating wheel and, for this, the most suitable height adjustment of the support guide must be found once again. The matching of these process parameters requires much experience.

So that the cumbersome adjustment by hand, optionally by trial and error and by test runs, will not have to be carried out whenever the machine is changed over to a new type of workpiece, it has already been proposed in DE 32 02 341 A1 a particular height adjustment of the support guide be assigned to each axial distance between the grinding disk and the regulating wheel. For this purpose, the regulating wheel is mounted in the usual manner in a headstock carriage, which can be screwed down in the direction of the grinding disk. When the grinding disk and the regulating wheel are adjusted to a particular axial distance corresponding to a particular diameter of the workpiece, a forced mechanical coupling between the headstock carriage and the support guide causes a particular value for the height setting of the support guide to come about at the same time. According to the proposal of the DE 32 02 341 A1, said adjustment can also be made during the grinding process when the contacting force of the grinding disk must be corrected. As a result, for each approach of the regulating wheel to the grinding disk, the support guide is raised by a certain amount at the same time.

However, the quite difficult processing position of the workpiece, once set, changes very rapidly when the external diameter of the workpiece decreases during the grinding. This is the case particularly when the diameter changes greatly, as it does very rapidly with the CBN grinding disks, the use of which is customary at the present time. However, if the optimum operating position of the workpiece between the grinding disk and the regulating wheel is disturbed, the grinding result also deteriorates; a labile position of the workpiece can also come about. In every case, the danger exists that the workpiece will be ground out of round. This deficiency cannot be eliminated with the known grinding device. Admittedly, by a selective adjustment by hand, the known grinding device permits some change in the distance between the grinding disk and the regulating wheel in a forced coupling with the height adjustment of the support guide. However, the possibilities of the device are no longer adequate to meet the present-day requirements for grinding accuracy in mass production.

It is therefore an object of the invention to provide a method for the centerless cylindrical grinding of the type named above, for which a position of the workpiece between the grinding disk, the regulating wheel and the support guide, required for an optimum grinding result, is ensured even in material that has been abraded heavily during the whole of the grinding process.

SUMMARY

This objective is accomplished by a method for centerless cylindrical grinding a rotationally symmetrical workpiece located between a grinding disk, a regulating wheel and the support guide wherein during the grinding process and a distance between the grinding disk and the regulating wheel as well as a height adjustment of the support guide is varied selectively and the height adjustment and/or an inclined position of the support guide is changed according to requirements of progression of the grinding process and automatically in accordance with an operational optimum adjustment.

The progress of the grinding process, which can be determined in various ways familiar to those skilled in the art by measurement or by empirical values, accordingly is used as an influencing variable, in order to adapt the position of the support guide to the contour of the workpiece, which changes during the grinding process. The correct processing position of the workpiece during the grinding process then leads to the greatest possible accuracy of the grinding result.

An advantageous development of the inventive method may consist therein that, during the grinding process, the contour of the workpiece is determined by measurement and the support guide is adjusted depending on the results of the measurement.

In so doing and in accordance with further advantageous developments, the diameter of the workpiece can be measured continuously or at intervals. It is, however, also possible to measure deviations of the contour of the workpiece from the circular shape continuously during the grinding process and, when a certain value of the deviation is exceeded, to change the height setting and/or the inclined position of the support guide in the sense of eliminating this deviation. The last-mentioned possibility can be combined with the continuous measurement of the diameter of the workpiece. The use of the above-mentioned influencing variables to adjust the support guide leads to great accuracy and dimensional consistency of the ground workpieces. However, this method of working is very expensive.

In mass production, it will frequently be possible to work more economically because the height adjustment and/or the inclined position of the support guide are controlled by a fixed operating program, which takes into consideration the changes, required for a particular type of workpiece, takes place as a function of the grinding cycle and is repeated for each individual workpiece. This development of the process, which is the object of a further advantageous development, accordingly undertakes the grinding process of each individual workpiece of a constant type in the form of an automatic program. If the number of items involved is sufficiently large, reliable typical values relating to the optimum adjustment of the support guide during the grinding process can readily be obtained, so that such an automatic program also leads to very good results.

Depending on the shape of the workpiece, which is to be ground, it is also possible to proceed according to a further, advantageous development so that, during the grinding process, the end surface of the workpiece is supported in the axial direction at its center of rotation by a fixed point, about which it is swiveled upward as a center of rotation. This procedure comes into consideration, for example, for valve bodies, which consist, as is known, of a valve head and a valve stem. The valve head and the valve stem can then be ground in a single process.

If the ground workpiece must meet particularly exacting requirements with regard to accuracy, the distance between the grinding disk and the regulating wheel can also be altered automatically in the sense of an operational optimum adjustment in addition to the height adjustment and/or the inclined position of the support guide. Since the regulating wheel and/or the grinding disk are generally mounted anyhow in an adjustable headstock carriage, this measure can be introduced in existing grinding machines without excessive difficulties.

Finally, according to a last, advantageous development, provisions can also be made so that the central axle of the regulating wheel is inclined with respect to the horizontal and in that the angle of inclination of the central axle is likewise adjusted automatically according to the demands of the advancing grinding process.

The invention also relates to a device for centerless, cylindrical grinding. In accordance with a device of DE 32 02 341 A1, named above, the starting point is a device for the centerless, cylindrical grinding with a driven grinding disk and a driven regulating wheel, of which at least one is mounted in a headstock carriage, which can be adjusted transversely to the axial direction of the workpiece, and with a support guide, which supports the workpiece, is located between the grinding disk and the regulating wheel and the height of which can be adjusted by means of at least one actuating drive.

To accomplish the objective already mentioned with regard to the device, especially for carrying out the method as related above, a control device is provided, which automatically actuates the actuating drive of the support guide during the grinding process in the sense of an adjustment optimum for the grinding process.

In contrast to the state of the art, the intervention by hand, which is difficult to estimate, is omitted thereby because, with the possibilities known at the present time for accurately controlling the grinding process, it is possible, on the basis of stored empirical values or calculated values, to enter accurate process parameters for automatically controlling the adjustment process.

From a mechanical point of view, the device can be configured advantageously so that two actuating drives are provided, which engage the support guide, are connected with the control device and can be actuated by the latter independently of one another in such a manner that, during the grinding process, the inclination of the support guide with respect to the horizontal can also be adjusted selectively.

Advantageously, adjusting spindles with CNC-controlled axes come into consideration as actuating drives, each adjusting spindle being individually controllable.

In particular, it is possible to proceed in such a manner, that two actuating drives, acting in the vertical direction in the longitudinal direction of the support guide, engage the latter at a distance from one another.

For workpieces of a suitable shape, such as valve bodies, the inventive device can be configured particularly advantageously owing to the fact that it has a support with a point, which is disposed in front of the support guide in the longitudinal direction of the latter and is directed towards the center of rotation of the workpiece, which is to be ground. For a device so configured, an accurate axial fixing of the workpiece during the grinding process is ensured so that, in spite of different external diameters and even when radial end surfaces or annular surfaces, which are to be ground, are present, an accurate result comes about.

For many cases, it will suffice if the support guide is a single, continuous body. However, in the case of rotationally symmetrical bodies with different diameter regions and according to a particularly advantageous proposal of the present invention, a supporting body, extending over the whole length of the support guide, is provided. The actuating drives engage this supporting body, to which two or more support bodies are hinged, which are connected with the supporting body over swiveling axes extending transversely to the longitudinal direction of the supporting body and having different supporting heights. The support guide thus consists of several parts. By means of the hinged support body, a workpiece with different allowances at the outer diameters can be supported well at the support guide and therefore be ground optimally.

If, at the same time, each support body is supported on either side of its swiveling axes by compression springs on the supporting body, a self-adjusting zero position of the supporting body can be achieved in a simple manner.

This development can be optimized even further owing to the fact that the swiveling axis between a support body and the supporting body is mounted on the side of the support body and the supporting body in a pre-tensioned bearing extending perpendicularly to the supporting body. The multi-part support guide becomes adaptable to such an extent therewith, that even workpieces with stepped, different diameters can be ground. By these means, it becomes possible to grind whole families of parts on the same grinding machine without changing over the support guide.

With regard to the control, the inventive device is configured particularly advantageously in accordance with a further proposal owing to the fact that a measuring device, by means of which the diameter and/or the deviations of the workpiece contour from the circular shape are measured during the grinding process, is assigned to the support guide and owing to the fact that the measuring device is connected with an evaluating unit, which, in turn, is connected for passing on control signals to the control unit.

A simpler and, for mass production, particularly well suited development of the inventive device may, however, also consist therein that the control device is connected with a programming unit, which supplies control signals, required for grinding a particular type of workpiece, to the control unit according to a time-dependent operating program and repeats for each individual workpiece of this type.

BRIEF DESCRIPTION OF THE FIGURES

The invention is described below in even greater detail by means of examples, which are shown in the Figures, of which FIG. 1 basically illustrates the process of the centerless circular grinding, the machine column, the support guide as well as the grinding disk and the regulating wheel, together with the workpiece, being shown only diagrammatically, FIG. 2 contains a diagrammatic representation for adjusting the support guide by means of two actuating drives, corresponding to the section A-A of FIG. 1.

DETAILED DESCRIPTION

Figure 1:
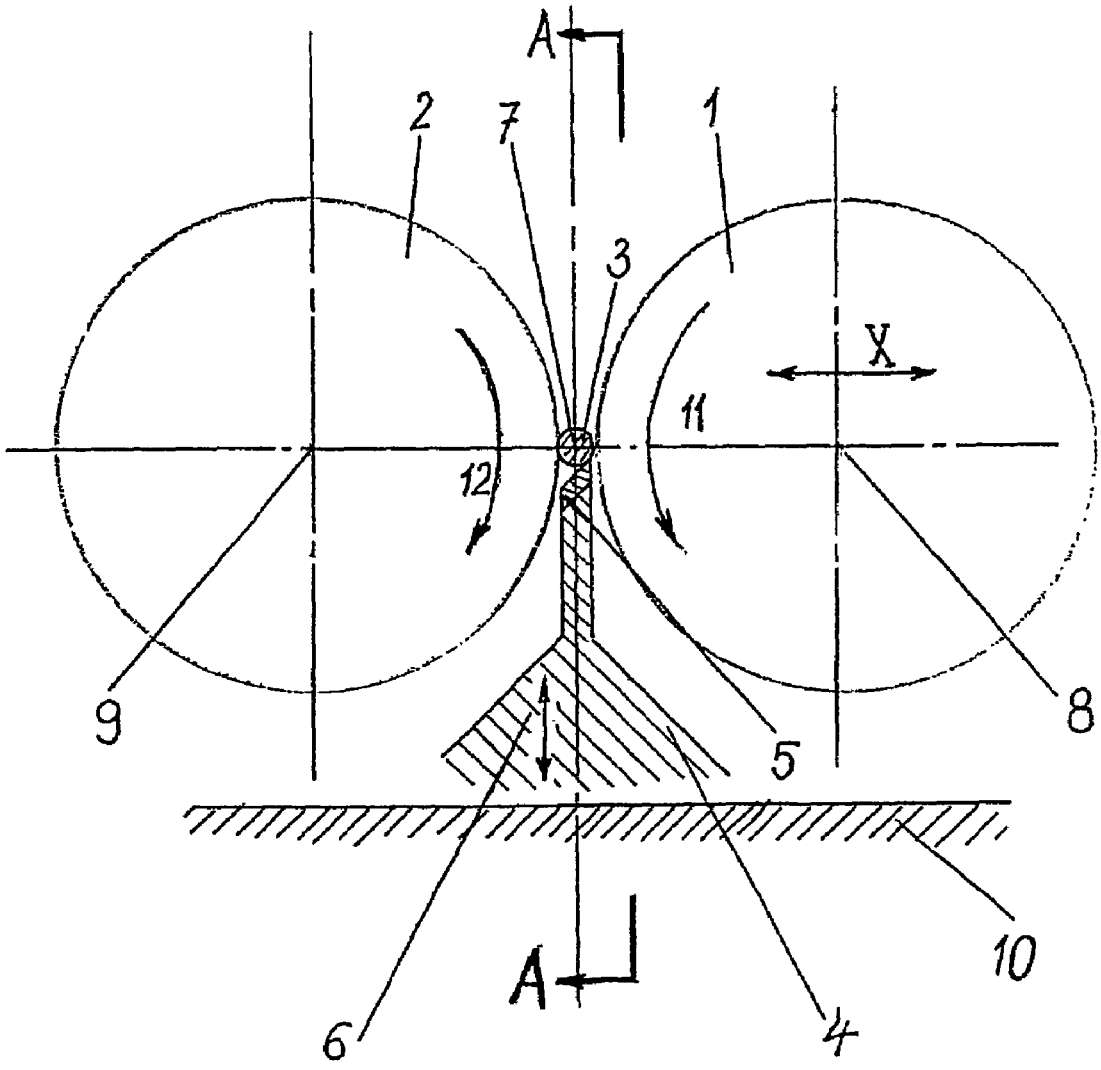

In FIG. 1, the process of centerless circular grinding is shown diagrammatically. A grinding disk 1 and a regulating wheel 2 are disposed essentially with parallel axes next to one another. The workpiece 3 is on a support guide 4, which is provided with a wear-resistant covering 5. The height of the support guide 4 is adjustable with respect to the machine column 10, as indicated by the double arrow 6. The central axes and, with that, also the axes of rotation of the workpiece 3, of the grinding disk 1 and of the regulating wheel 2 are indicated by 7, 8 and 9.

So that the workpiece 3 can be caused to rotate, the regulating wheel 2 must be driven rotationally that is, it must be rotated about its central axis 9. Through contact with the workpiece 3 at its outer diameter, the latter is caused to rotate. For grinding the surface of the workpiece, the grinding disk 1 is also caused to rotate about its central axes 8. The directions of rotation of the grinding disk 1 and of the regulating wheel 2 are indicated by the curved directional arrows 11 and 12. In the case of conventional and known machines for centerless circular grinding, the grinding disk 1 is taken up in a main headstock and the regulating wheel 2 in a regulating wheel headstock. One or both headstocks may be mounted movably in the x direction on a common machine column 10. As is well known, the x direction is the one extending transversely to the longitudinal direction of the workpiece. The construction of such headstocks and the driving mechanisms of the disks are customary in the art, so that the details are not shown.

The position of the workpiece 3 on the support guide 4 is not defined as clearly as one might have expected from the diagrammatic representation of FIG. 1. Namely, in order to achieve an advance, the regulating wheel 2 must be disposed with an axis tilted slightly from the horizontal. With that, the workpiece is also adjusted so as to be inclined somewhat downward, which can be compensated for by an inclined position of the support guide. So that the true-to-size surfaces, ground to a precise contour, come about, the workpiece must occupy a very particular position between the grinding disk 1, the regulating wheel 2 and the support guide 4. However, a position, set ever so accurately at the beginning of the grinding process, is changed rapidly once again if the diameter and the contour of the workpiece are changed as a consequence of the grinding process. This is particularly the case with the CBN grinding disks, which are customary at the present time.

The remedy consists therein that, during the grinding process, the support guide is raised further and also its inclination is corrected, until the optimum relationships are restored and the workpiece is ground cylindrically.

Figure 2:
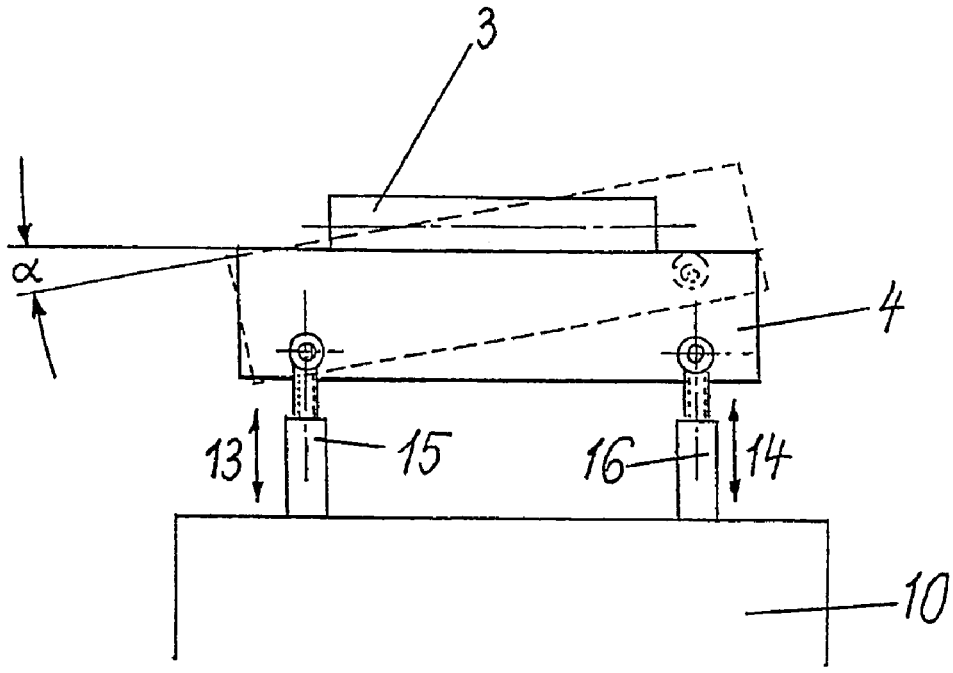

By means of a sectional representation of FIG. 1, FIG. 2 therefore explains how the adjustment of the support guide takes place during the grinding process. For this purpose, the support guide 4 with the workpiece 3 rests on two actuating drives 15 and 16, which, in turn, are supported on the machine column 10. The actuating drives are at a distance from one another in the longitudinal direction of the support guide 4. In the example shown, the actuating drives are formed by adjusting spindles with CNC-controlled axes, each adjusting spindle being individually controllable. Parallel shifting of the control guide upward can be achieved owing to the fact that the two adjusting spindles are controlled synchronously. If, in addition, it is necessary to incline the support guide 4 by the angle $\alpha$ with respect to the horizontal, the actuating drive 16 must be shifted more than the actuating drive 15. The adjusting directions of the actuating drives are marked in FIG. 2 by double arrows 13 and 14.

Figure 3:
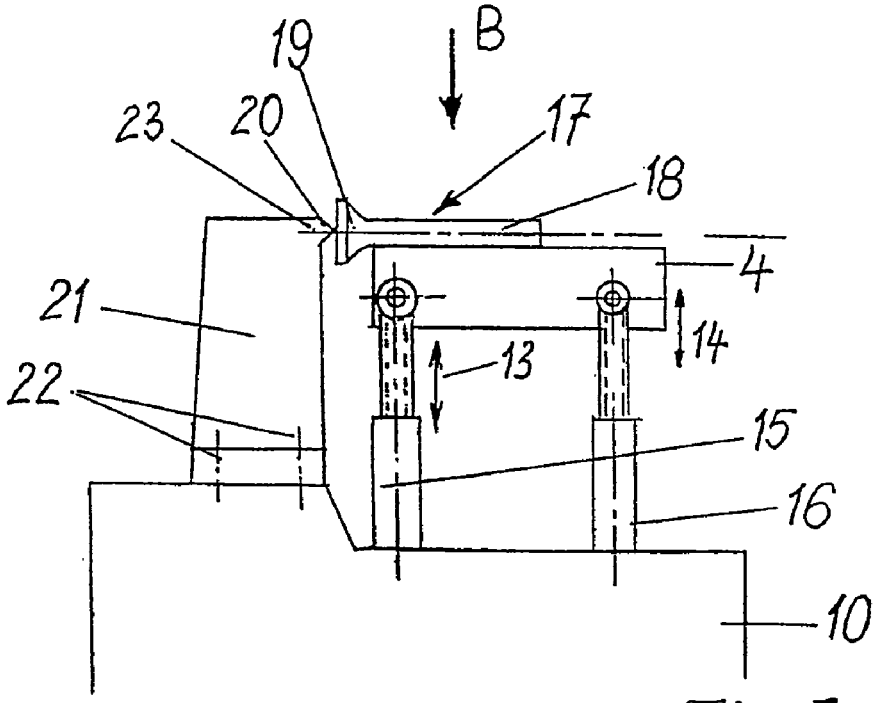
FIG. 3 shows the grinding of a rotationally symmetrical workpiece with different diameter regions and also corresponds to section A-A of FIG. 1.

FIG. 3 also contains a representation corresponding to section A-A of FIG. 1. The workpiece here is a valve body 17, which consists, in the usual manner, of a stem 18 with the valve head 19. Admittedly, here also, the valve body 17 rests on a support guide 4. However, an additional support 21 is fastened here by means of screws 22 to the machine column 10 and a point 20 is formed at the support 21. The front surface of the valve head 19 of the valve body 17 is supported at this point 20. Accordingly, it cannot happen that the valve body 17, under the influence of the axial grinding forces resulting from grinding the bevel at the valve seat, can migrate in the axial direction out of the grinding zone.

The central axis of the point 20 essentially is at the same height as the central axis of the grinding disk. The axis of rotation of the valve body 17 corresponds approximately to the central axis 23 of the point 20, as long as the support body is horizontal.

Figure 4:
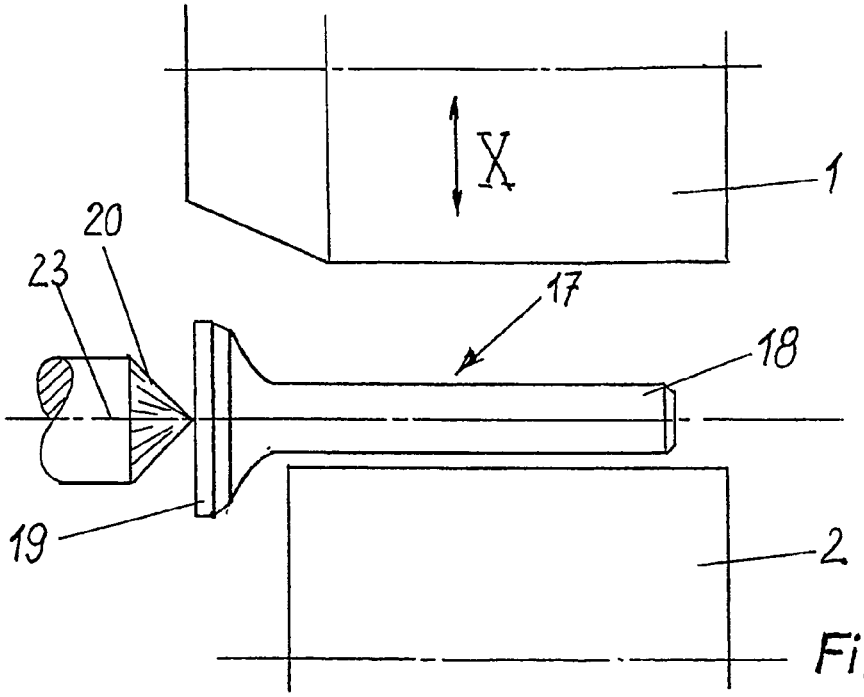
FIG. 4 is a view corresponding to arrow B of FIG. 3

These relationships are shown even better in FIG. 4, which contains a view corresponding to arrow B in FIG. 3.

Figure 5:
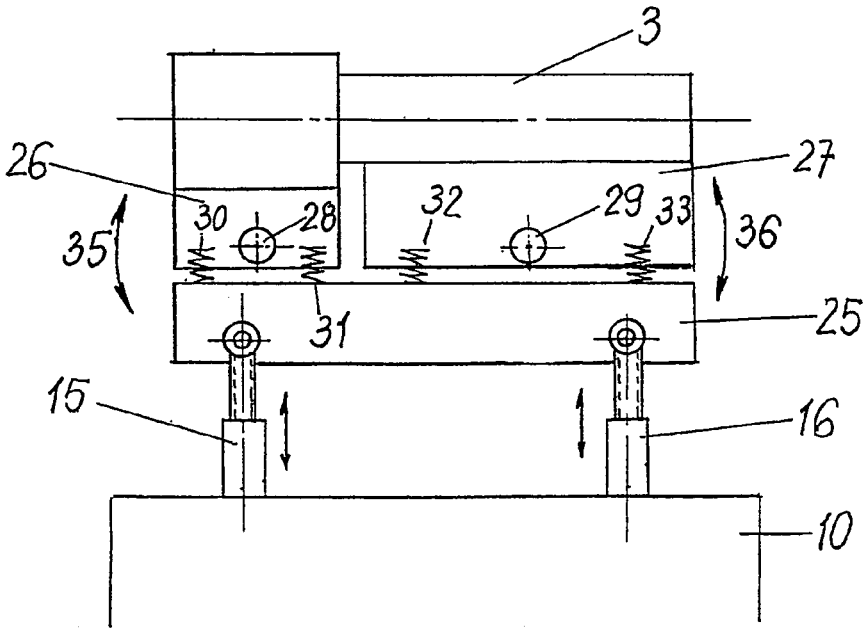
FIG. 5 illustrates the principle of a multipart support guide corresponding to section A-A of FIG. 1.

FIG. 5 illustrates a support guide 24 in a multi-part construction. It consists, to begin with, of a supporting body 25, which is supported, in the same manner as to the support guide shown in FIG. 2 by two actuating drives 15 and 16 at the machine column 10. An inclined position of the supporting body 25 can be achieved here also by adjusting the actuating drives 15 and 16 differently. What is different here, however, is that the supporting bodies 25 are hinged on two support bodies 26, 27. For this purpose, swiveling axes 28, 29, which extend transversely to the longitudinal axis of the supporting body, are provided. The support bodies 26, 27 are thereby connected in the form of rockers with the supporting body 25. Their swiveling ability is indicated by the round arrows 35 and 36. The support bodies may have different support heights.

On either side of the swiveling axes, the support bodies 26, 27 are supported by compression springs 30, 31 and 32, 33 on the supporting body 25. By these means, a zero position is reached easily for a possible oscillating movement of the supporting body 25, 26.

In the case of this construction, the support bodies 26, 27 can adapt themselves up to a certain degree to the workpiece, the diameter of which deviates from the nominal dimension. During the grinding process, the oscillating movement is compensated for by the process forces, which act on the support body and are superimposed on the spring forces.

A further advantage of the multi-part support guide of FIG. 5 consists therein that, due to the oscillating movement of the support bodies 26, 27, workpieces of different diameters can be ground on this guide. As a result, it is possible to grind complete families of parts on the same machine without changing over the support guide. Larger differences in the diameter can also be equalized owing to the fact that the swiveling axis 28, 29, which is between a support body 26, 27 and the supporting body 25, can be brought to different height positions by adjusting the two actuating drives 15, 16.

The invention claimed is:

1. A method for centerless cylindrical grinding of a rotationally symmetrical workpiece having a workpiece axis by means of a grinding machine comprising a grinding wheel rotating about a grinding wheel axis, and a regulating wheel and a support guide, the method comprising:

positioning the workpiece between the grinding wheel, the regulating wheel and the support guide;

supporting the support guide to support the workpiece and adjust an angle of inclination of the workpiece axis relative to a plane including the grinding wheel axis;

rotationally driving the grinding wheel and the regulating wheel to grind the workpiece; and automatically adjusting elevation and inclination of the support guide so as to adjust inclination of the workpiece axis relative to the plane including the grinding wheel axis as a function of grinding progress.

2. The method according to claim 1, wherein the inclination of the support guide is adjusted by adjusting the height of the support guide independently at two sites on the support guide spaced from each other in a direction parallel to an axis of the workpiece.

3. The method according to claim 2, wherein the grinding machine further comprises a fixed structure having a point and the workpiece has an end face in contact with the point such that the workpiece pivots about said point as the support guide is adjusted.

4. The method according to any one of claims 1 to 3, further comprising automatically adjusting axial inclination of the regulating wheel relative to the grinding wheel axis as a function of progress of the grinding.

5. The method according to claim 4, wherein the automatically adjusting axial inclination of the support guide as a function of grinding progress includes adjusting elevation and inclination of the support guide as a function of grinding time repeated for each individual workpiece.

6. The method according to any one of claims 1 to 3, wherein the automatically adjusting elevation and inclination of the support guide as a function of grinding progress includes adjusting elevation and inclination of the support guide as a function of grinding time repeated for each individual workpiece.

7. The method according to any one of claims 1 to 3, further comprising measuring deviations of the workpiece from a circular shape and the automatically adjusting elevation and inclination of the support guide as a function of grinding progress including adjusting elevation and inclination of the support guide in response to said deviations to eliminate said deviations.

8. The method according to claim 2, wherein the support guide is mounted at said two sites by pivots each having a pivot axis transverse to said workpiece axis.

9. An apparatus for centerless cylindrical grinding, comprising:

a grinding wheel, means for rotationally driving the grinding wheel about a grinding wheel axis;

a regulating wheel;

means for rotationally driving the regulating wheel, a headstock carriage on which at least one of the grinding wheel and the regulating wheel is mounted;

a support guide located between the grinding wheel and the regulating wheel for supporting a rotationally symmetrical workpiece for rotation about a workpiece axis of rotational symmetry of the workpiece and configured to adjust an angle of inclination of the workpiece axis relative to a plane including the grinding wheel axis;

the headstock carriage being adjustable transversely to said axis;

at least one actuating drive for adjusting height and inclination of the support guide so as to adjust inclination of the workpiece axis relative to the plane including the grinding wheel axis;

a control for automatically actuating the actuating drive during grinding of the workpiece to adjust the height and the inclination of the support guide; and a source of programmed control signals for the control so that the adjustment of the height and inclination of the support guide is correlated with progress of the grinding.

10. The apparatus according to claim 9, wherein the at least one actuating drive comprises first and second independently actuatable actuating drives.

11. The apparatus according to claim 10, wherein the first and the second actuating drives are each connected to the support guide at a respective one of two sites.

12. The apparatus according to claim 11, wherein the actuating drives comprise adjusting spindles and the control comprises a CNC, and the spindles are controlled by the CNC.

13. The apparatus according to claim 12, further comprising means defining a fixed point for engaging an end face of the workpiece at a point on said axis, said fixed point being spaced from the support guide away from the grinding wheel and the regulating wheel in a direction parallel to said axis.

14. The apparatus according to claim 11, wherein the support guide comprises a first body to which said actuating drives are connected and second and third bodies mounted on said first body for supporting the workpiece at two different elevations at respective two locations spaced from each other in a direction parallel to said axis and respective means for supporting the second and third bodies for rocking of each about a respective axis transverse to said workpiece axis.

15. The apparatus according to claim 14, further comprising, for each of the second and the third bodies, respective pairs of compression springs, each compression spring having one end engaging the second or the third body and another end engaging the first body, the springs of each said pair being spaced on opposite sides of the transverse rocking axis of the respective second and third bodies in directions parallel to the axis of the workpiece.

16. The apparatus according to any one of claims 8 to 14, wherein the control signals for adjusting elevation and inclination of the support guide as a function of grinding progress adjust elevation and inclination of the support guide as a function of grinding time repeated for each individual workpiece.

17. The apparatus according to any one of claims 8 to 14, further comprising means for measuring deviations of the workpiece from a circular shape, and the source of control signals being responsive to measured deviations to provide control signals automatically adjusting elevation and inclination of the support guide to eliminate the deviations.

18. The apparatus according to claim 11, wherein the support guide is mounted to said first and second actuating drives at two respective locations spaced from each other in a direction parallel to said workpiece axis by pivots each having a pivot axis transverse to said workpiece axis.

* * * * *